US010537819B2

(12) United States Patent
Waddell et al.

(10) Patent No.: US 10,537,819 B2
(45) Date of Patent: Jan. 21, 2020

(54) TACTILE ORBITING CONCENTRATION DEVICE

(71) Applicants: Selene S. Waddell, Tucson, AZ (US); Jesse T. Waddell, Tucson, AZ (US)

(72) Inventors: Selene S. Waddell, Tucson, AZ (US); Jesse T. Waddell, Tucson, AZ (US)

( * ) Notice: Subject to any disclaimer, the term of this patent is extended or adjusted under 35 U.S.C. 154(b) by 0 days.

(21) Appl. No.: 16/046,751

(22) Filed: Jul. 26, 2018

(65) Prior Publication Data

US 2019/0030448 A1 Jan. 31, 2019

Related U.S. Application Data

(60) Provisional application No. 62/538,361, filed on Jul. 28, 2017.

(51) Int. Cl.
*A63H 33/00* (2006.01)
*A63H 23/00* (2006.01)
*A63H 1/30* (2006.01)

(52) U.S. Cl.
CPC ..... *A63H 33/00* (2013.01)

(58) Field of Classification Search
CPC ..... A63H 33/00; A63H 1/00
USPC ..... 446/129, 220, 236, 450, 256
See application file for complete search history.

(56) References Cited

U.S. PATENT DOCUMENTS 2,582,788 A * 1/1952 Mendelsohn ..... F16C 32/0412 310/90.5
2,747,944 A * 5/1956 Baermann ..... F16C 32/0425 310/90.5
3,217,446 A * 11/1965 Steiert ..... A63H 33/26 446/138
3,493,274 A * 2/1970 Emslie ..... F16C 32/0436 310/90.5
3,614,181 A * 10/1971 Meeks ..... F16C 32/0417 310/90.5
3,794,391 A * 2/1974 Grosbard ..... F16C 32/044 310/90.5
4,295,832 A * 10/1981 Karell ..... A63F 9/0098 273/456
5,182,533 A * 1/1993 Ritts ..... A63H 33/26 310/90.5
5,506,459 A * 4/1996 Ritts ..... A63H 1/00 310/90.5
6,356,000 B1 * 3/2002 Ho ..... H02K 53/00 310/154.01
7,115,043 B2 * 10/2006 Leadbetter ..... A63B 53/14 473/257

(Continued)

*Primary Examiner* — Nini F Legesse
(74) *Attorney, Agent, or Firm* — Quarles & Brady LLP

(57) ABSTRACT

A spinner apparatus is disclosed herein. In one embodiment, the spinner comprises a magnetic ring; a rod, wherein the rod extends through the middle of the magnetic ring; and a first cap, wherein the first cap connects to a first end of the rod; and a second cap, wherein the second cap connects to a second opposite end of the rod. In another embodiment, the spinner comprises a first magnetic ring; a second magnetic ring; a magnet spacer, wherein the magnet spacer is disposed between the first and the second magnetic rings; a rod, wherein the rod extends through the middle of the first and the second magnetic rings; a first cap, wherein the first cap connects to a first end of the rod; and a second cap, wherein the second cap connects to a second opposite end of the rod.

26 Claims, 6 Drawing Sheets

(56) References Cited

U.S. PATENT DOCUMENTS

| | | | | |
|---|---|---|---|---|
| 2008/0057821 | A1* | 3/2008 | Perry | A63H 1/02<br>446/46 |
| 2011/0212665 | A1* | 9/2011 | Van Dan Elzen | A63H 1/30<br>446/250 |

* cited by examiner

TACTILE ORBITING CONCENTRATION DEVICE

CROSS-REFERENCE TO RELATED APPLICATION

This application claims the benefit of and priority to U.S. Provisional Patent Application No. 62/538,361, filed on Jul. 28, 2017, the disclosure of which is incorporated herein by reference in its entirety.

TECHNICAL FIELD

The present invention relates to hand held devices that can spin and, more particularly, to hand held spinning devices that can help to reduce stress and maintain focus.

BACKGROUND OF THE INVENTION

Hand held interactive devices have been created to spin, flick, flip, fold, click, and rub with the intention of calming the user and improving concentration. Spinners are very popular hand held devices commonly used today. Precision roller bearings and large masses afford spinners low friction rotation and long spin times, however the distracting noise created by the internal roller balls is unavoidable. Thus a device for hand operation that can rotate quietly, with low friction, is desirable. Further, what is desirable is the ability to attach a multitude of various shaped ferrous metal objects to the external magnetic ring surfaces of the spinners and non-ferrous end caps of the spinners. What is also preferred is the ability for ferrous metal objects of various sizes to stay attached to the spinner while static or rolling on the external ring surfaces of the spinner, thereby enabling cylindrical or spherical shaped objects to revolve while orbiting around the center of the spinner. Additionally, it is preferred to have a hand operated device that generates vibratory sensations in the hand and arm of the user while in use.

SUMMARY OF THE INVENTION

An embodiment of the present invention provides a spinner. In certain embodiments, the spinner comprises a magnetic ring; a rod, wherein the rod extends through the middle of the magnetic ring; and a first cap, wherein the first cap connects to a first end of the rod; and a second cap, wherein the second cap connects to a second opposite end of the rod. Further, the magnetic ring and the rod extending therethrough are disposed between the first cap and the second cap; and the magnetic ring spins around the rod.

In certain embodiments, the spinner comprises a first magnetic ring; a second magnetic ring; a magnet spacer, wherein the magnet spacer is disposed between the first and the second magnetic rings; a rod, wherein the rod extends through the middle of the first and the second magnetic rings; a first cap, wherein the first cap connects to a first end of the rod; and a second cap, wherein the second cap connects to a second opposite end of the rod. Further, the first and the second magnetic rings and the rod extending therethrough are disposed between the first cap and the second cap; and the first and the second magnetic rings both spin around the rod.

BRIEF DESCRIPTION OF THE DRAWINGS

The invention will be more fully understood by referring to the following Detailed Description of Specific Embodiments in conjunction with the Drawings, of which.

DETAILED DESCRIPTION OF SPECIFIC EMBODIMENTS

Figure 1A:
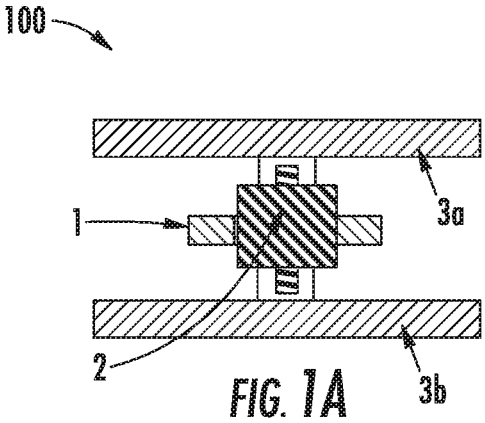
FIGS. 1A-1H illustrate cross-sectional views of one embodiment of a spinner 100.
Figure 1B:
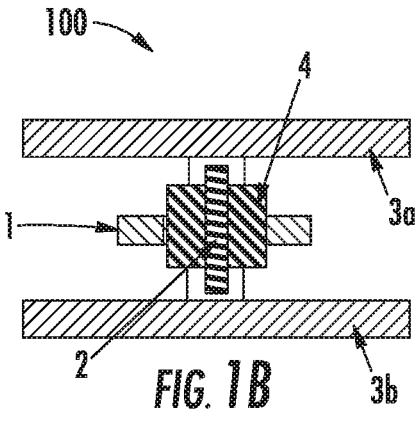
Figure 1C:
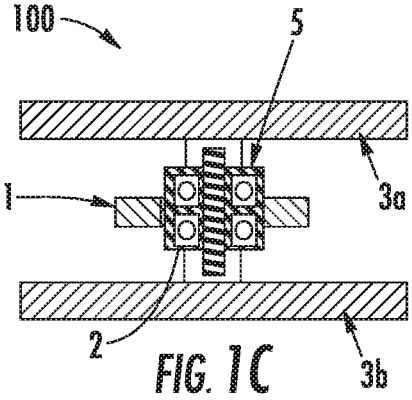

References throughout this specification to "one embodiment," "an embodiment," "a related embodiment," or similar language mean that a particular feature, structure, or characteristic described in connection with the referred to "embodiment" is included in at least one embodiment of the present invention. Thus, appearances of the phrases "in one embodiment," "in an embodiment," and similar language throughout this specification may, but do not necessarily, all refer to the same embodiment. It is to be understood that no portion of disclosure, taken on its own and in possible connection with a figure, is intended to provide a complete description of all features of the invention.

In addition, the following disclosure may describe features of the invention with reference to corresponding drawings, in which like numbers represent the same or similar elements wherever possible. In the drawings, the depicted structural elements are generally not to scale, and certain components are enlarged relative to the other components for purposes of emphasis and understanding. It is to be understood that no single drawing is intended to support a complete description of all features of the invention. In other words, a given drawing is generally descriptive of only some, and generally not all, features of the invention. A given drawing and an associated portion of the disclosure containing a description referencing such drawing do not, generally, contain all elements of a particular view or all features that can be presented is this view, for purposes of simplifying the given drawing and discussion, and to direct the discussion to particular elements that are featured in this drawing. A skilled artisan will recognize that the invention may possibly be practiced without one or more of the specific features, elements, components, structures, details, or characteristics, or with the use of other methods, components, materials, and so forth. Therefore, although a particular detail of an embodiment of the invention may not be necessarily shown in each and every drawing describing such embodiment, the presence of this detail in the drawing may be implied unless the context of the description requires otherwise. In other instances, well known structures, details, materials, or operations may be not shown in a given drawing or described in detail to avoid obscuring aspects of an embodiment of the invention that are being discussed.

The invention as recited in claims appended to this disclosure is intended to be assessed in light of the disclosure as a whole. A spinners contains inertial masses of various shapes and sizes that spin around a central axis enabled by a central roller bearing and end caps attached to the bearing inner race. In the current disclosure, embodiments of spinners enable quiet, low friction rotation utilizing magnetic rings, onto which a multitude of small ferrous metal objects can be attached. Magnetically attached spherical and cylindrical ferrous metal shaped objects can roll, therefore dynamically revolve while orbiting about the spinner's central rod. The highly configurable spinner can be easily changed to meet individual needs. For instance, the spinner can be configured to come to rest after being spun by the user correlating with the time to take a calm deep breath or to generate a variety of vibratory sensations through the caps. Lower resultant spin times, relative to the prior spinner art, encourages more continual user interaction. This continual user interaction is believed to be more calming to the active mind. The spinner can also be configured for auditory stimulus to meet the user's preference, including silent options to limit distraction to others. The spinner can also be configured to include massage function or to be an element of furniture.

In accordance with preferred embodiments of the present invention, with reference to FIGS. 1A-1H, one embodiment of a spinner 100 is illustrated. With reference to FIGS. 2A-2F and 3A, another embodiment of a spinner 200 is depicted. Further, with reference to FIG. 3B, yet another embodiment of a spinner 300 is disclosed; and with reference to FIG. 3C, yet another embodiment of a spinner 400 is illustrated.

Figure 1D:
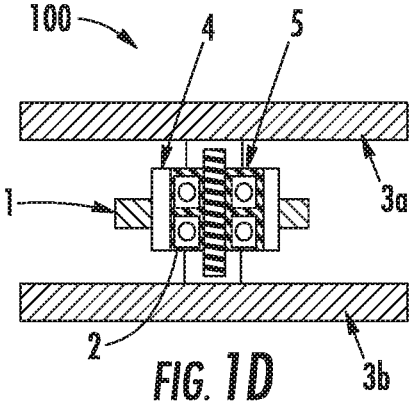
Figure 1E:
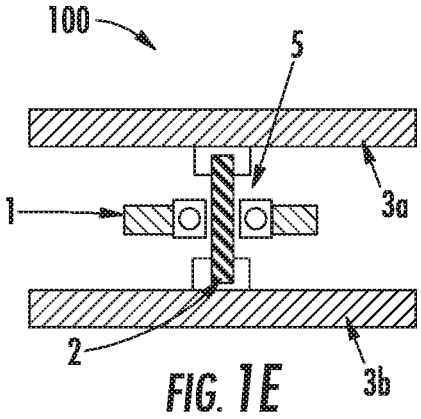
Figure 1F:
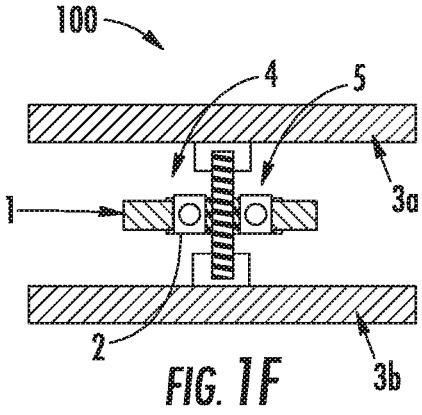

For spinner 100, it comprises a magnetic ring 1, a rod 2, a first cap 3*a*, and a second cap 3*b* (FIG. 1A). In certain embodiments, spinner 100 further comprises a spacer 4 (FIG. 2A) that is disclosed between magnetic ring 1 and rod 2. In certain embodiments, spinner 100 further comprises a roller bearing 5 (FIG. 1C) that is disclosed between magnetic ring 1 and rod 2. Referring to FIG. 1D, spinner 100 comprises both spacer 4 and roller bearing 5, which is disposed between magnetic ring 1 and rod 2. Further, spacer 4 is disposed between roller bearing 5 and magnetic ring 1.

Figure 1G:
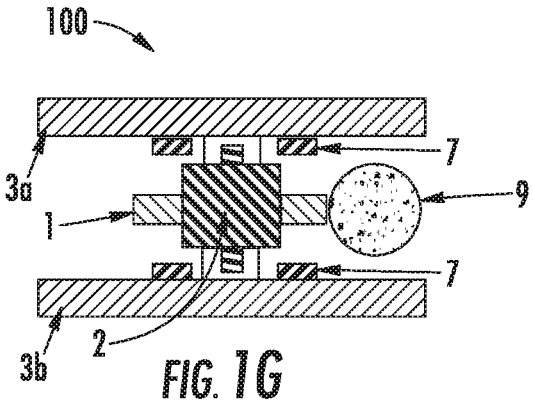
Figure 1H:
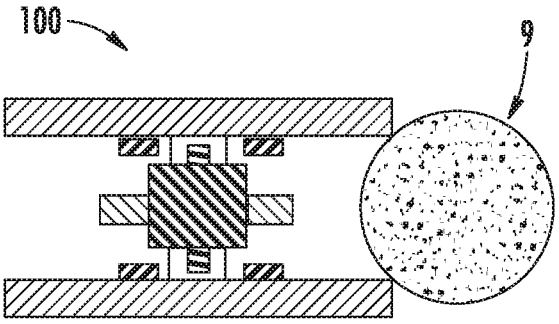

Referring to FIGS. 1G and 1H, spinner 100 comprises at least one magnetic element 7, which is disposed between magnetic ring 1 and first cap 3*a* or second cap 3*b*. In some embodiments, at least one shock absorbing element could be disposed between magnetic ring 1 and first cap 3*a* or second cap 3*b*. Further, spinner 100 comprises at least one object 9 that is configured to magnetically connect to an outer surface of magnetic ring 1 and orbit about magnetic ring 1. In some embodiments, spinner 100 comprises a plurality of 10 objects 9. In other embodiments, spinner 100 comprises a plurality of 20 objects 9. While specific values chosen for the number of objects 9 are recited, it is to be understood that, within the scope of the invention, the number of objects 9 is modified according to diameters of objects 9 and magnetic ring 1. Additionally, the size of object 9 also varies as long as object 9 is able to magnetically connect to magnetic ring(s). In some embodiments, object 9 is configured to fit between the inner surfaces of first cap and second cap and object 9 does not physically contact both inner surface of first cap and second cap (FIG. 1G). In other embodiments, object 9 is not configured to fit between the inner surfaces of first cap and second cap and object 9 physically contacts rims of first cap and second cap (FIG. 1H).

Figure 2A:
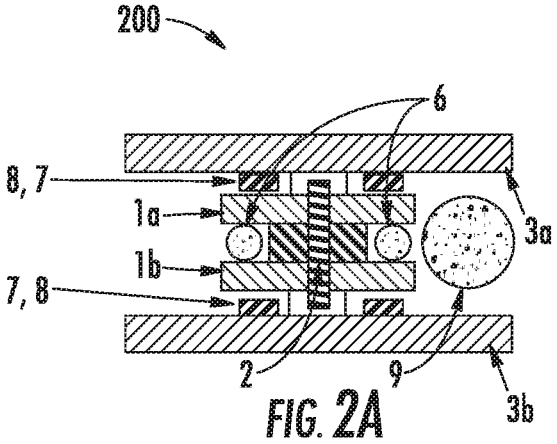
FIGS. 2A-2F show cross-sectional views of another embodiment of a spinner 200.
Figure 2B:
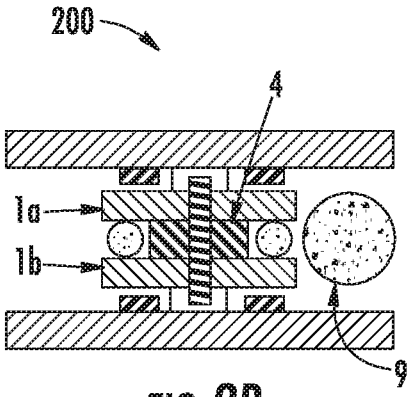
Figure 2C:
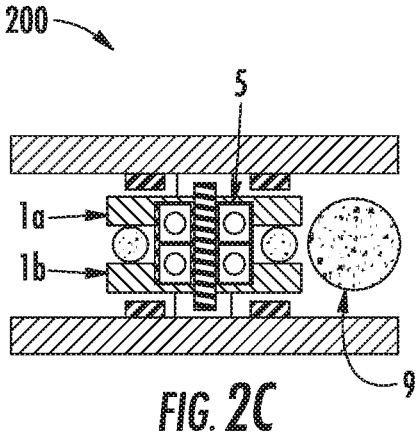
Figure 2D:
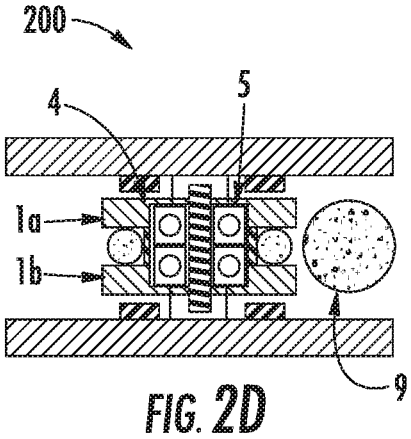
Figure 2E:
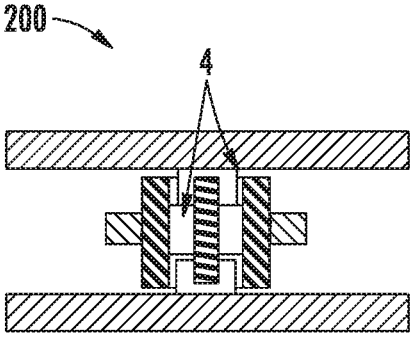
Figure 2F:
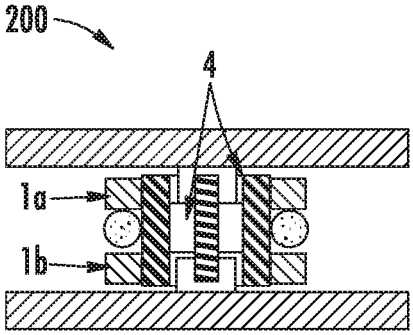
Figure 3A:
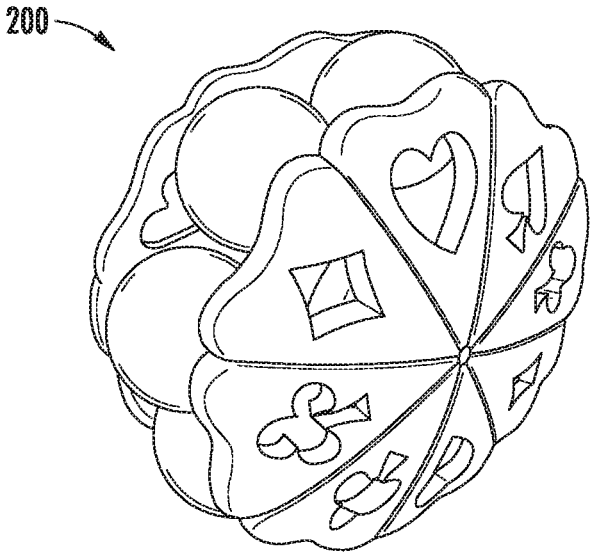
FIG. 3A illustrates spinner 200.
Figure 3B:
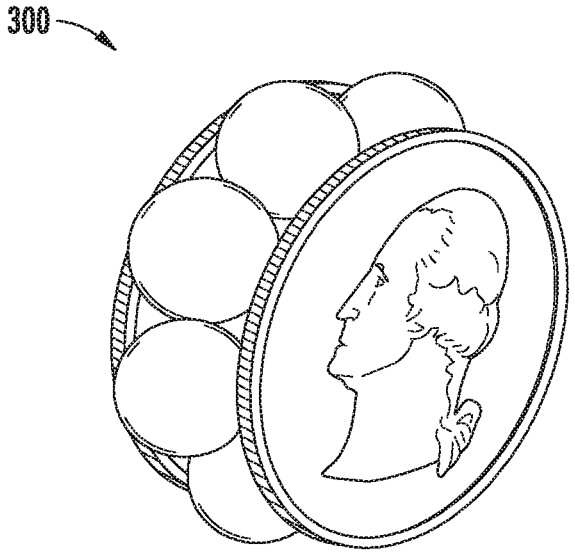
FIG. 3B illustrates another embodiment of spinner 300.
Figure 3C:
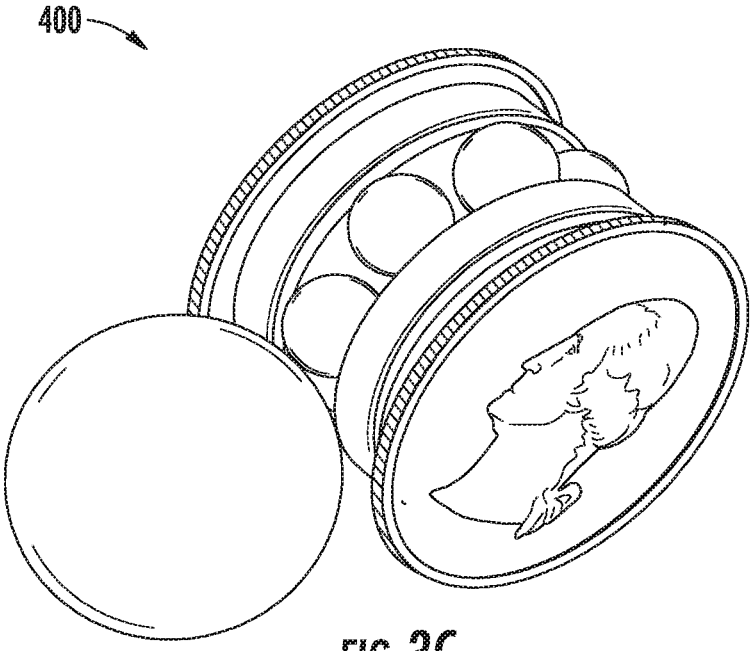
FIG. 3C illustrates yet another embodiment of spinner 400.

With respect to spinner 200, referring to FIGS. 2A-2F, it comprises a first magnetic ring 1*a* and a second magnetic ring 1*b*, a magnetic spacer 6, a rod 2, a first cap 3*a*, and a second cap 3*b*. Referring to FIG. 2A, the magnetic spacer 6 is disposed between first magnetic ring 1*a* and second magnetic ring 1*b*. Spacer 6 located between first and second magnetic rings creates a conduit for objects 9 so that objects 9 can stably travel around the circumferential track. The magnetic spacer 6 could be but is not limited to spherical, cylindrical annulus, and toroidal shaped objects. In certain embodiments, spinner 200 further comprises a roller bearing 5 (FIG. 2C) that is disclosed between magnetic rings 1*a*-1*b* and rod 2. Referring to FIG. 2D, spinner 200 comprises both spacer 4 and roller bearing 5, which is disposed between rod 2 and spacer 4. Further, spacer 4 is disposed between roller bearing 5 and magnetic rings 1*a*-1*b*. In certain embodiments, referring to FIGS. 2E and 2F, an additional layer of spacer 4 is implemented between magnetic rings 1*a*-1*b* and rod 2.

Similarly to spinner 100, in certain embodiments, spinner 200 comprises at least one magnetic element 7, which is disposed between magnetic ring 1*a* and first cap 3*a* or between second magnetic ring 1*b* and second cap 3*b*. In some embodiments, at least one shock absorbing element could be disposed between magnetic ring 1*a* and first cap 3*a* or between second magnetic ring 1*b* and second cap 3*b*. Moreover, in certain embodiments, spinner 200 comprises at least one object 9 that is configured to magnetically connect to an outer surface of magnetic rings 1*a*-1*b* and orbit about magnetic rings 1*a*-1*b*. In certain embodiments, object 9 comprises ferrous materials. In some embodiments, spinner 100 comprises a plurality of 10 objects 9. In other embodiments, spinner 100 comprises a plurality of 20 objects 9. While specific values chosen for the number of objects 9 are recited, it is to be understood that, within the scope of the invention, the number of objects 9 are modified according to diameters of first and second caps.

Referring to FIGS. 1G, 1H, and 2A-2D, the first cap 3*a* is connected to a first end of rod 2 and the second cap 3*b* is connected to a second and opposite end of rod 2. In certain embodiments (e.g., the embodiment of FIG. 2A), aromatherapy diffuser pads 8 are placed at the location of magnetic elements 7 for adding essential oils are included between magnetic rings and first and second caps. Should spinners 100 and 200 be accidentally dropped by the user on a hard surface, the diffuser pads also act to shock isolate the magnetic rings during subsequent impact between the caps and the hard surface. Caps 3*a*-3*b* can be plain, artful, or decorative and may be of various size, shapes, cut outs, and textures. First cap 3*a* and second cap 3*b* comprise non-ferrous materials. The caps 3*a*-3*b* hold spinners 100-400 together and protect a user from powerful magnetic surfaces of the magnetic rings. The caps, further improved with shock absorbing pads between caps and magnetic elements, provide means to improve magnet ring survival if device is accidentally dropped onto a hard surface.

In certain embodiments, the rotatable magnetic rings are naturally self-centering about the midpoint of the rod, enabling the magnetic rings and various attached ferrous objects to float between the caps and rotate quietly with low friction when spun. The magnetic rings afford many configurable exterior track options as any small ferrous objects can be attached to them. In certain embodiments, the spacer 4 is configured to reduce rotational friction and shock isolation of magnetic rings and rod.

Objects 9 dynamically revolve as they orbit around the spinner's central rod, which is afforded by object 9's ability to stay attached to and roll on the external magnetic ring surface that may or may not be rotating about the rod as well. When multiple objects 9 are attached to the track (the outer surface of the magnetic ring(s)), the objects will naturally distribute evenly around the track circumference due to magnetic field interaction and impacting other objects. The quietest track configuration minimizes the gaps between multiple objects or has none or one object. Alignment of the spinner's central rod with earth gravity while spinning minimizes both rotational friction and multiple objects impact acoustic levels. Objects impact acoustic levels increase proportionately as the spinner's central rod is rotated normal to earth gravity.

In certain embodiments, whether the relatively quiet spinning of the magnetic rings alone, or a track filled with multiple objects impacting one another, the user is provided with concurrent sight (vision), hearing (audition), smell (olfaction), and touch (somatosensation) feedback enabling a multi-sensory experience.

What is claimed is:

1. A spinner, comprising:

a magnetic ring;

a rod having a first end and a second, opposite end, wherein the rod extends through the middle of the magnetic ring, and wherein the magnetic ring is magnetically self-centering between the first and second ends of the rod;

a first cap, wherein the first cap connects to the first end of the rod; and a second cap, wherein the second cap connects to the second end of the rod;

wherein:

the magnetic ring and the rod extending therethrough are disposed between the first cap and the second cap; and the magnetic ring is free to spin around the rod.

2. The spinner of claim 1, further comprising a cylindrical roller bearing disposed between the magnetic ring and the rod, wherein the rod extends through the roller bearing.

3. The spinner of claim 2, wherein the cylindrical roller bearing comprises a plurality of rolling elements.

4. The spinner of claim 1, further comprising a cylindrical spacer disposed between the cylindrical roller bearing and the magnetic ring.

5. The spinner of claim 1, further comprising at least one object, wherein:

the at least one object is magnetically connected to an outer circumferential surface of the magnetic ring; and the at least one object is configured to orbit around a long axis of the rod.

6. The spinner of claim 5, wherein the at least one object is disposed between the inner surface of the first cap and the inner surface of the second cap.

7. The spinner of claim 5, wherein the at least one object is a sphere.

8. The spinner of claim 5, wherein the at least one object comprises a ferrous material.

9. The spinner of claim 1, wherein the rod comprises a ferrous material.

10. The spinner of claim 1, wherein each of the first and the second caps comprises a convex outer surface and a concave inner surface, wherein:

each convex outer surface of the first cap and the second cap is configured to allow the spinner to rotate on a flat surface; and the first cap and the second cap comprise a non-ferrous material.

11. The spinner of claim 1, further comprising at least one magnetic element disposed between the magnetic ring and either the first cap or the second cap.

12. The spinner of claim 1, further comprising at least one shock absorbing element disposed between the magnetic ring and either the first cap or the second cap.

13. A spinner, comprising:

a first magnetic ring;

a second magnetic ring;

a spacer, wherein the spacer is disposed between the first and the second magnetic rings;

a rod having a first end and a second end opposite the first end, wherein the rod extends through the middle of the first and the second magnetic ring;

a first cap, wherein the first cap connects to the first end of the rod; and a second cap, wherein the second cap connects to the second end of the rod;

wherein:

the first and the second magnetic rings and the rod extending therethrough are disposed between the first cap and the second cap;

the first and the second magnetic rings are both free to spin around the rod, and the first magnetic ring, the second magnetic ring and the spacer comprise a magnetic ring assembly that is magnetically self-centering between the first and second ends of the rod.

14. The spinner of claim 13, wherein the first magnetic ring and the second magnetic ring do not touch each other and are parallel to each other.

15. The spinner of claim 14, further comprising a cylindrical roller bearing disposed between the first and second magnetic rings and the rod, wherein the rod extends through the roller bearing.

16. The spinner of claim 15, wherein the cylindrical roller bearing comprises a plurality of rolling elements.

17. The spinner of claim 13, further comprising at least one cylindrical spacer disposed between the rod and the first and second magnetic rings.

18. The spinner of claim 13, further comprising at least one object, wherein:

the at least one object is magnetically connected to an outer circumferential surface of both the first and the second magnetic rings; and the at least one object is able to orbit around a long axis of the rod.

19. The spinner of claim 18, wherein the at least one object is disposed between the inner surface of the first cap and the inner surface of the second cap.

20. The spinner of claim 18, wherein the at least one object comprises a ferrous material.

21. The spinner of claim 13, wherein the rod comprises a ferrous material.

22. The spinner of claim 13, wherein each of the first and the second caps comprises a convex outer surface and a concave inner surface, wherein:

each convex outer surface of the first cap and the second cap is configured to allow the spinner to stand on a flat surface; and the first cap and the second cap comprise a non-ferrous material.

23. The spinner of claim 13, further comprising at least one magnetic element disposed between the first magnetic ring and the first cap and/or between the second magnetic ring and the second cap.

24. The spinner of claim 13, further comprising at least one shock absorbing element disposed between the magnetic ring and either the first cap or the second cap.

25. The spinner of claim 13, wherein the spacer comprises a hollow cylinder.

26. The spinner of claim 13, wherein the first and second magnetic rings define, therebetween, an annular volume that extends around a long axis of the rod, and further comprising, a plurality of spherical objects in magnetic contact with the first and second magnetic rings such that they are located in the annular in the channel and are free to rotate about the long axis of the rod.

* * * * *